US012484674B2

(12) United States Patent
Zhou

(10) Patent No.: US 12,484,674 B2
(45) Date of Patent: Dec. 2, 2025

(54) MAGNETIC SUCTION TYPE CARD SHOWING ASSEMBLY

(71) Applicant: Shenzhen Youlequ Trading Co., Ltd., Shenzhen (CN)

(72) Inventor: Meng Zhou, Shenzhen (CN)

(73) Assignee: Shenzhen Youlequ Trading Co., Ltd., Shenzhen (CN)

( * ) Notice: Subject to any disclaimer, the term of this patent is extended or adjusted under 35 U.S.C. 154(b) by 0 days.

(21) Appl. No.: 19/189,134

(22) Filed: Apr. 24, 2025

(65) Prior Publication Data

US 2025/0248498 A1 Aug. 7, 2025

(30) Foreign Application Priority Data

Apr. 15, 2025 (CN) ..... 202520704651.2

(51) Int. Cl.
*A45C 11/24* (2006.01)
*A45C 13/04* (2006.01)
*A45C 13/10* (2006.01)

(52) U.S. Cl.
CPC ..... *A45C 11/24* (2013.01); *A45C 13/04* (2013.01); *A45C 13/1069* (2013.01); *A45C 2200/15* (2013.01)

(58) Field of Classification Search
CPC ..... A45C 11/24; A45C 13/04; A45C 13/1069; A45C 2200/15
See application file for complete search history.

(56) References Cited

U.S. PATENT DOCUMENTS

2005/0247798 A1 11/2005 Graves et al.
2008/0268963 A1* 10/2008 Deutchman ..... H04B 1/3888 463/47
2013/0015081 A1* 1/2013 Wu ..... A45C 11/00 206/216
2013/0127308 A1* 5/2013 Yang ..... A45C 11/00 312/223.1
2014/0116896 A1* 5/2014 Simmer ..... H04M 1/04 206/37
2014/0246340 A1* 9/2014 Jiang ..... A45C 11/00 206/45.23
2018/0081405 A1* 3/2018 Shinotou ..... E05D 11/1028
2021/0022467 A1* 1/2021 Cox ..... A45C 13/1069
2021/0350194 A1 11/2021 Montealegre et al.
2022/0114919 A1* 4/2022 McEnery ..... A45F 5/155
2022/0261607 A1 8/2022 Montealegre et al.

* cited by examiner

*Primary Examiner* — Gary C Hoge

(57) ABSTRACT

A magnetic suction type card showing assembly is provided, including a showing box; and an accommodating box detachably arranged in the showing box in a snap-in manner, wherein a card is detachably placed in the accommodating box. The showing box includes a main framework; a transparent cover plate fixedly arranged at an opening in one end of the main framework; a plurality of magnetic suction members respectively fixedly arranged on a side wall of the main framework; and a supporting frame detachably accommodated at a side edge of the main framework and can rotate relative to the main framework.

15 Claims, 8 Drawing Sheets

MAGNETIC SUCTION TYPE CARD SHOWING ASSEMBLY

TECHNICAL FIELD

The present disclosure relates to the technical field of card boxes, and in particular, to a magnetic suction type card showing assembly.

BACKGROUND

A card showing box is a specific packaging box for placing precious cards, and its structure and appearance are particularly important for showing of the cards. On the one hand, the card showing box plays a protective role, and on the other hand, the card showing box performs a showing operation on the cards. Some existing card showing boxes can only be placed flatly or supported, and are not suitable for card showing boxes that need to be hung. Some card showing boxes are stacked up and down for card showing. In this placement mode, only products on an upper layer can be seen, and products on a lower layer cannot be shown, thereby affecting a card showing effect. Therefore, a magnetic suction type card showing assembly is provided to address the above issues.

SUMMARY

An objective of the present disclosure is to provide a magnetic suction type card showing assembly, to solve a problem that an existing card showing box cannot meet a showing need of a user because of its single showing mode.

A magnetic suction type card showing assembly of the present disclosure can be implemented through the following technical solutions:

The magnetic suction type card showing assembly of the present disclosure includes a showing box, which is a hollow framework with an opening in one end; and an accommodating box, which is detachably arranged in the showing box in a snap-in manner, wherein a card is detachably placed in the accommodating box.

The showing box includes a main framework, the accommodating box being detachably accommodated inside the main framework; a transparent cover plate fixedly arranged at the opening in one end of the main framework; a plurality of magnetic suction members respectively fixedly arranged on a side wall of the main framework, the card showing assembly being arranged on a showing wall through magnetic suction of the plurality of magnetic suction members; and a supporting frame detachably accommodated at a side edge of the main framework and capable of rotating relative to the main framework, to implement a supporting operation on the main framework.

In an implementation, the main framework is a rectangular cavity with openings in two ends; a clamping slot is provided in an inner side of the main framework; and the accommodating box is detachably arranged inside the clamping slot in a snap-in manner.

In an implementation, the accommodating box includes a first shell and a second shell that are detachably connected to each other, and the first shell and the second shell form a hollow cavity; and the card is placed in the cavity.

In an implementation, the second shell is detachably arranged on the first shell in a magnetic suction manner or a snap-in manner.

In an implementation, an accommodating slot is provided in the side edge of the main framework, and the supporting frame is rotatably arranged in the accommodating slot.

In an implementation, rotation holes are symmetrically provided in two opposite sides of the accommodating slot in a penetrating manner; two ends of the supporting frame are respectively rotatably arranged in the corresponding rotation holes; and a plurality of limiting holes are respectively provided in side edges of the rotation holes.

In an implementation, the supporting frame includes two rotation rods which are oppositely arranged and are respectively rotatably connected to the main framework; and a connecting rod fixedly connected between the two rotation rods.

In an implementation, the two rotation rods are integrally formed with the connecting rod.

In an implementation, rotation pins are fixedly arranged on the rotation rods; the rotation pins are rotatably arranged in the corresponding rotation holes; limiting columns are fixedly arranged at side edges of the rotation pins; and the limiting columns are capable of being respectively in detachable snap-in connection to the plurality of limiting holes.

In an implementation, the two rotation rods and the connecting rod are respectively rotatably accommodated in the accommodating slot; clamping edges are arranged at side edges of the two rotation rods and a side edge of the connecting rod in a surrounding manner; and the clamping edges can be in detachable snap-in connection to a side edge of the accommodating slot.

In an implementation, a plurality of fixing cavities are arranged on the side wall of the main framework, and the plurality of magnetic suction members are respectively fixedly arranged in the corresponding fixing cavities.

In an implementation, the magnetic suction members use strong magnets.

In an implementation, an annular clamping strip is arranged on one side of the main framework in a protruding manner; the clamping strip and the transparent cover plate are arranged on the same side; and the clamping strip is higher than a horizontal plane of the transparent cover plate.

In an implementation, the transparent cover plate is made of a polystyrene (PS) material and is rectangular; and four sides of the transparent cover plate are fixedly connected to an open end of the main framework through glue.

In an implementation, both the main framework and the supporting frame are made of a thermoplastic polyurethane (TPU) material.

Compared with the prior art, the magnetic suction type card showing assembly of the present disclosure has the beneficial effects:

A card in the magnetic suction type card showing assembly can be arranged on a showing wall for showing through suction of the magnetic suction members or can be supported in different angles by the supporting frame for showing, or the supporting frame can be folded onto the main framework for horizontal showing. A user can select different showing modes according to actual needs, and a problem that an existing card showing box cannot meet a showing need of a user because of a single showing mode is effectively solved. Meanwhile, the clamping strip is arranged in the main framework in the snap-in manner, so that stacking and storage between a plurality of card showing assemblies are implemented, and magnetic suction connection between two adjacent showing boxes is implemented. In addition, by the snap-in connection between the limiting columns and different limiting holes, the magnetic suction type card showing assembly is supported in different angles, which can improve user satisfaction to a particular extent.

BRIEF DESCRIPTION OF THE DRAWINGS

For clearer descriptions of the technical solutions of the embodiments of the present disclosure, the accompanying drawings required to be used in the embodiments are briefly introduced below. It should be understood that the accompanying drawings below are only some embodiments of the present disclosure. Therefore, the embodiments shall not be regarded as limitations on the scope. A person of ordinary skill in the art can also derive other relevant drawings according to these drawings without creative work.

Figure 1:
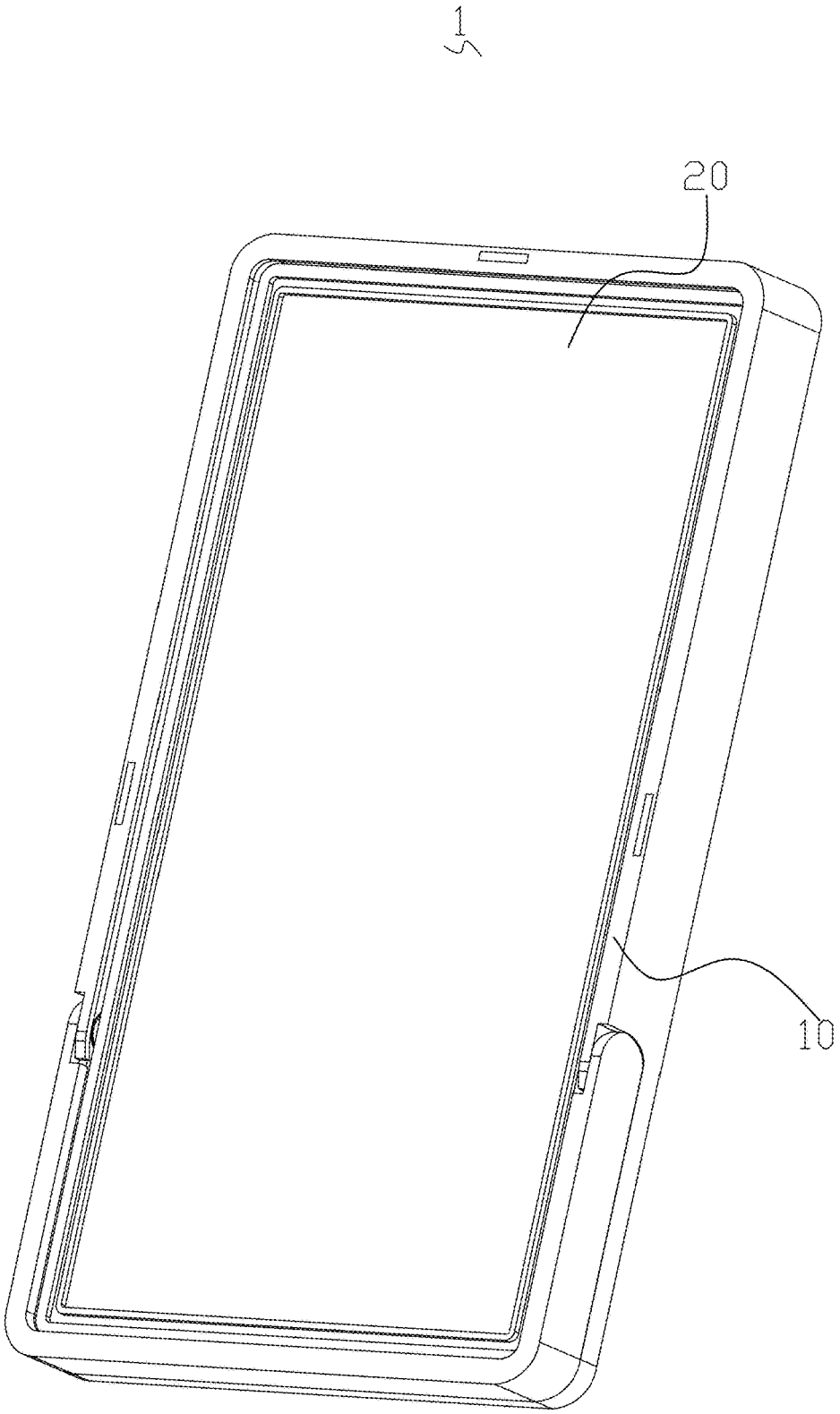
FIG. 1 is a schematic diagram of a three-dimensional structure of a magnetic suction type card showing assembly according to the present disclosure, including a showing box and an accommodating box.

Numerals in the drawings: 1: magnetic suction type card showing assembly; 10: showing box; 11: main framework; 111: clamping slot; 112: accommodating slot; 1121: rotation hole; 1122: limiting hole; 113: fixing cavity; 114: clamping strip; 12: transparent cover plate; 13: magnetic suction member; 14: supporting frame; 141: rotation rod; 1411: rotation pin; 1412: limiting column; 142: connecting rod; 1421: clamping edge; 20: accommodating box; 21: first shell; and 22: second shell.

DETAILED DESCRIPTION OF THE EMBODIMENTS

In order to make the objectives, technical solutions, and advantages of the embodiments of the present disclosure clearer, the technical solutions in the embodiments of the present disclosure are clearly described below with reference to the accompanying drawings in the embodiments of the present disclosure. Apparently, the described embodiments are merely some rather than all of the embodiments of the present disclosure. Assemblies of the embodiments of the present disclosure commonly described and shown in the accompanying drawings here may be arranged and designed in a variety of different configurations.

Therefore, the following detailed descriptions of the embodiments of the present disclosure provided in the accompanying drawings are not intended to limit the scope of the claimed present disclosure, but merely represents selected embodiments of the present disclosure. All other embodiments obtained by a person of ordinary skill in the art based on the embodiments of present disclosure without making creative efforts shall fall within the protection scope of present disclosure.

Figure 2:
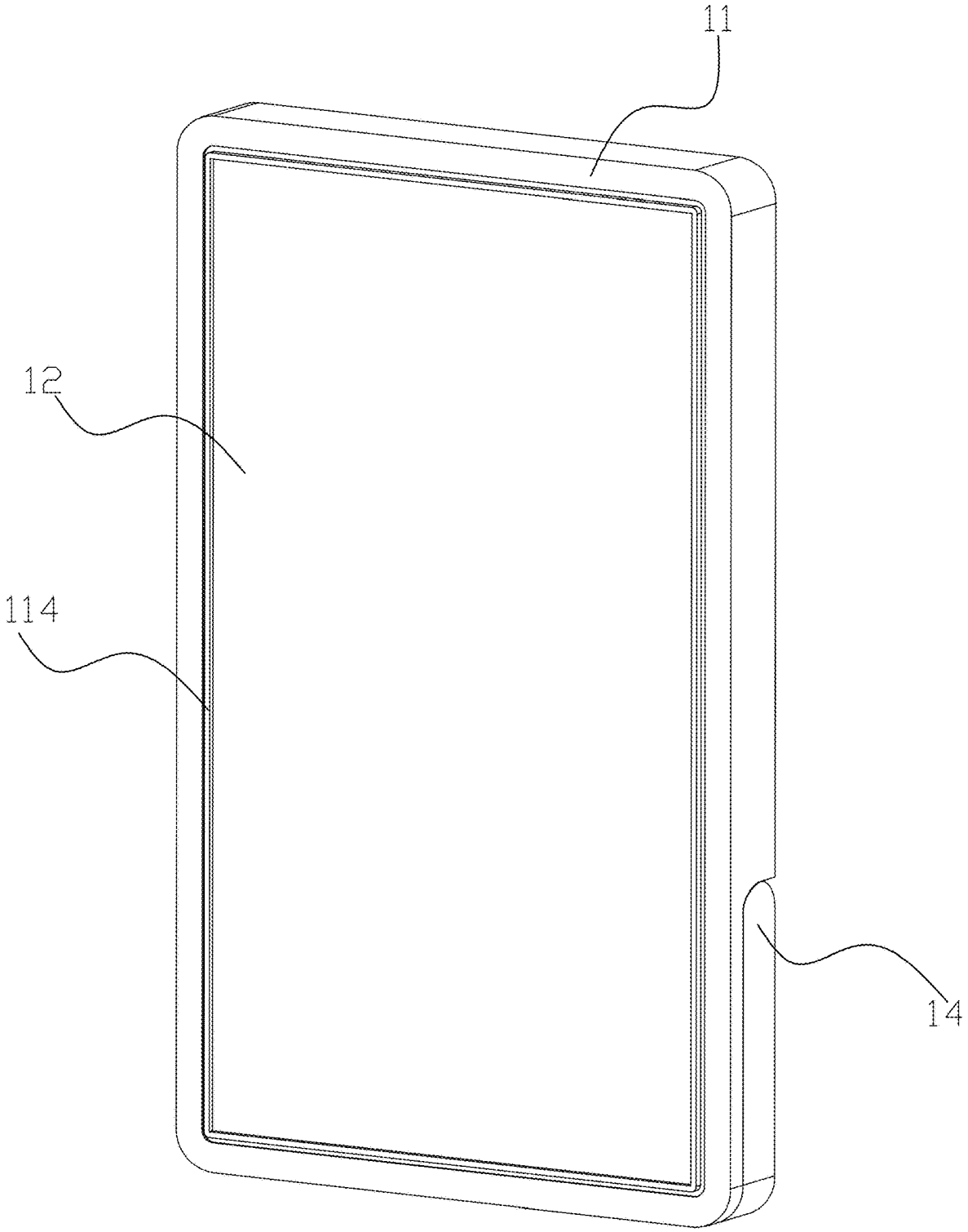
FIG. 2 is a schematic diagram of a three-dimensional structure of a magnetic suction type card showing assembly according to the present disclosure, in another view.
Figure 3:
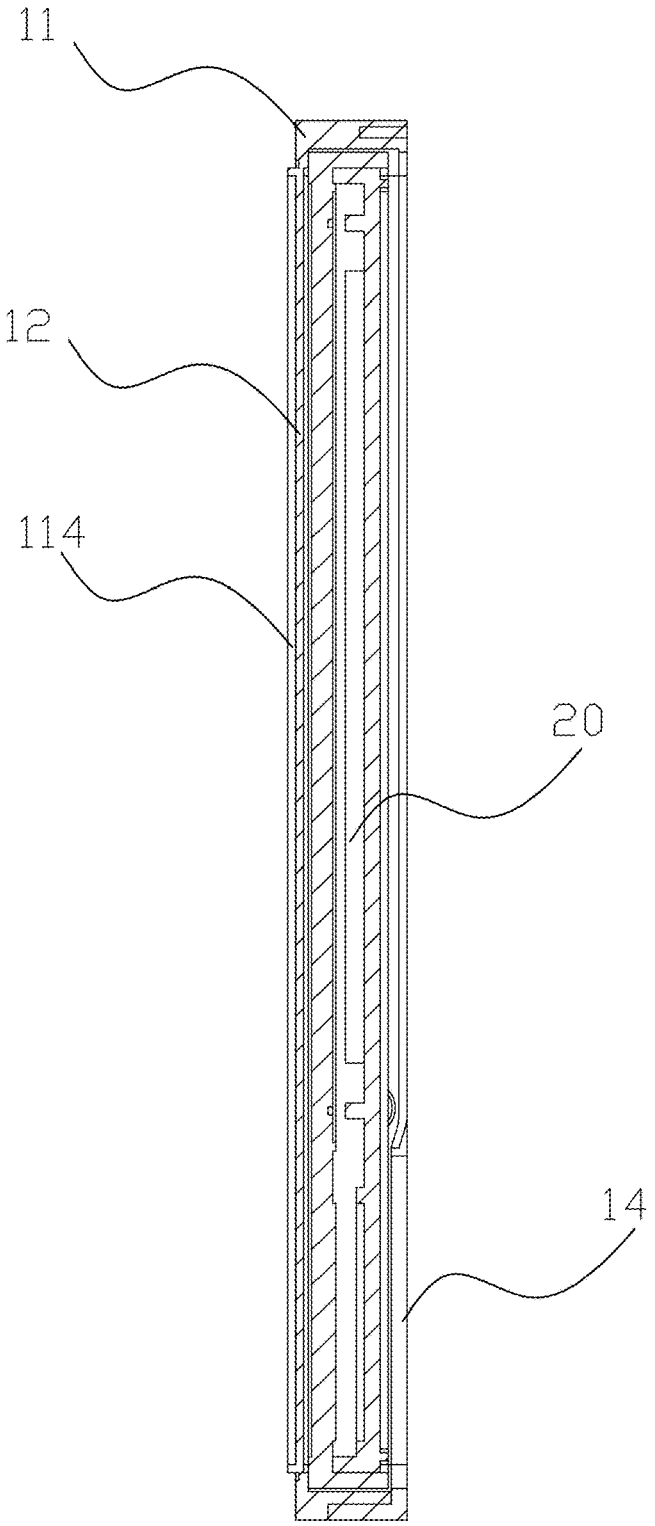
FIG. 3 is a schematic diagram of a longitudinally sectional structure of a magnetic suction type card showing assembly according to the present disclosure.
Figure 4:
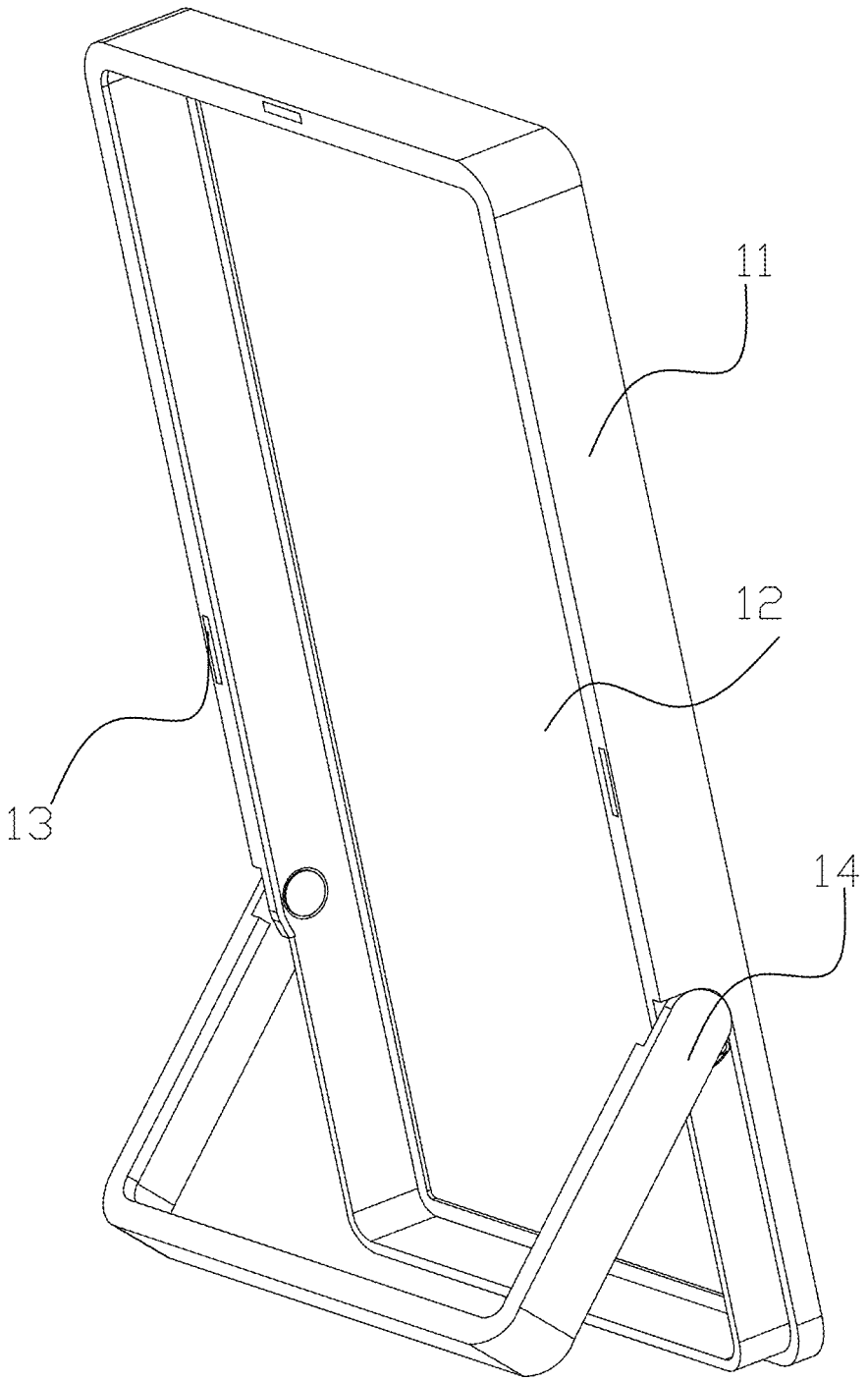
FIG. 4 is a schematic diagram of a three-dimensional structure of the showing box shown in FIG. 1 in an opened state.

Referring to FIG. 1 to FIG. 3, a magnetic suction type card showing assembly 1 of the present disclosure includes a showing box 10 and an accommodating box 20. The showing box 10 is a hollow framework with an opening in one end, which can perform magnetic suction and supporting operations. The accommodating box 20 is detachably arranged in the showing box 10 in a snap-in manner. A card is detachably placed in the accommodating box 20. The accommodating box 20 protects the card inside the accommodating box, and the showing box 10 shows and protects the accommodating box 20.

Referring to FIG. 1 to FIG. 5, in this embodiment, the showing box 10 mainly includes a main framework 11, a transparent cover plate 12, a plurality of magnetic suction members 13, and a supporting frame 14. The main framework 11 is a hollow cavity with openings in two ends. The accommodating box 20 is detachably accommodated inside the main framework 11. The transparent cover plate 12 is fixedly arranged at the opening in one end of the main framework 11. Through the transparent cover plate 12, the card arranged inside the accommodating box 20 can be observed, and the accommodating box 20 can be protected. The plurality of magnetic suction members 13 are respectively fixedly arranged on a side wall of the main framework 11. The plurality of magnetic suction members 13 are detachably sucked onto a vertically arranged showing wall, thereby facilitating showing of the card arranged in the showing box 10. The supporting frame 14 can be folded and accommodated on a side edge of the main framework 11, and can be rotated relative to the main framework 11, thereby supporting the main framework 11 and facilitating a supporting and showing operation to be performed on the card in the showing box 10.

Referring to FIG. 1 to FIG. 6, in this embodiment, the main framework 11 uses a rectangular cavity with openings in two ends, and a clamping slot 111 is provided in an inner side of the main framework. The accommodating box 20 is detachably arranged inside the clamping slot 111 in a snap-in manner, thereby limiting and fixing the accommodating box 20 arranged inside the main framework 11. An accommodating slot 112 is provided in a side edge of the main framework 11, and the supporting frame 14 is rotatably arranged in the accommodating slot 112, so that the supporting frame 14 is folded and accommodated at the side edge of the main framework 11. The plurality of fixing cavities 113 are arranged on a side wall of the main framework 11. The plurality of magnetic suction members 13 are respectively fixedly arranged in the corresponding fixing cavities 113. The magnetic suction type card showing assembly is detachably sucked onto a showing wall through the magnetic suction action of the plurality of magnetic suction members 13. An annular clamping strip 114 is arranged on one side of the main framework 11 in a protruding manner. The clamping strip 114 and the transparent cover plate 12 are arranged on the same side, and the clamping strip 114 is higher than a horizontal plane of the transparent cover plate 12. In such a design, an outer surface of the transparent cover plate 12 can be prevented from being scratched. Meanwhile, the clamping strip 114 is detachably limited and clamped on a back surface of the main framework 11 of another showing box 10, to facilitate limitation and stacking on a plurality of showing boxes 10.

Figure 5:
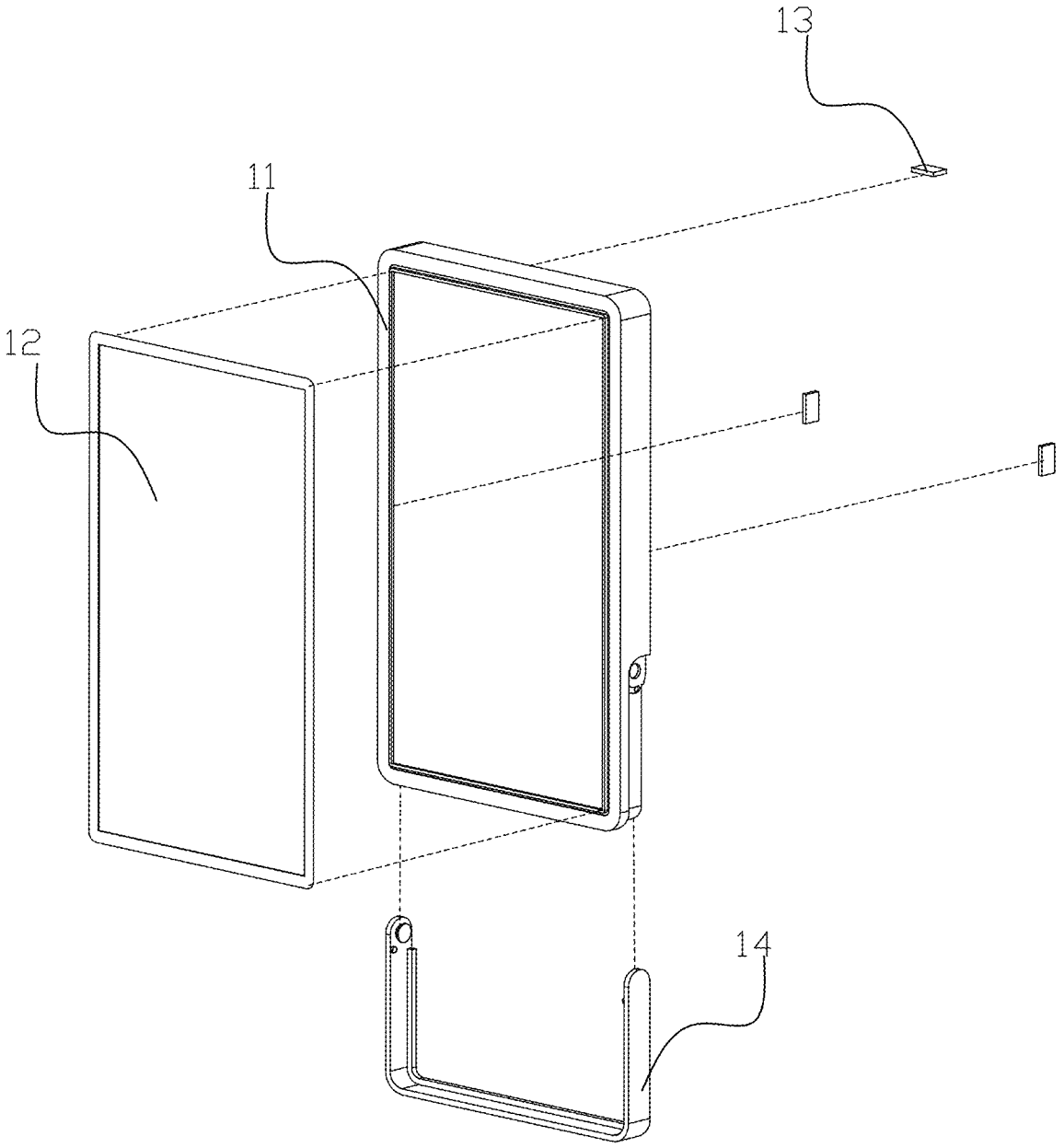
FIG. 5 is a schematic diagram of an exploded structure of the showing box shown in FIG. 1.
Figure 6:
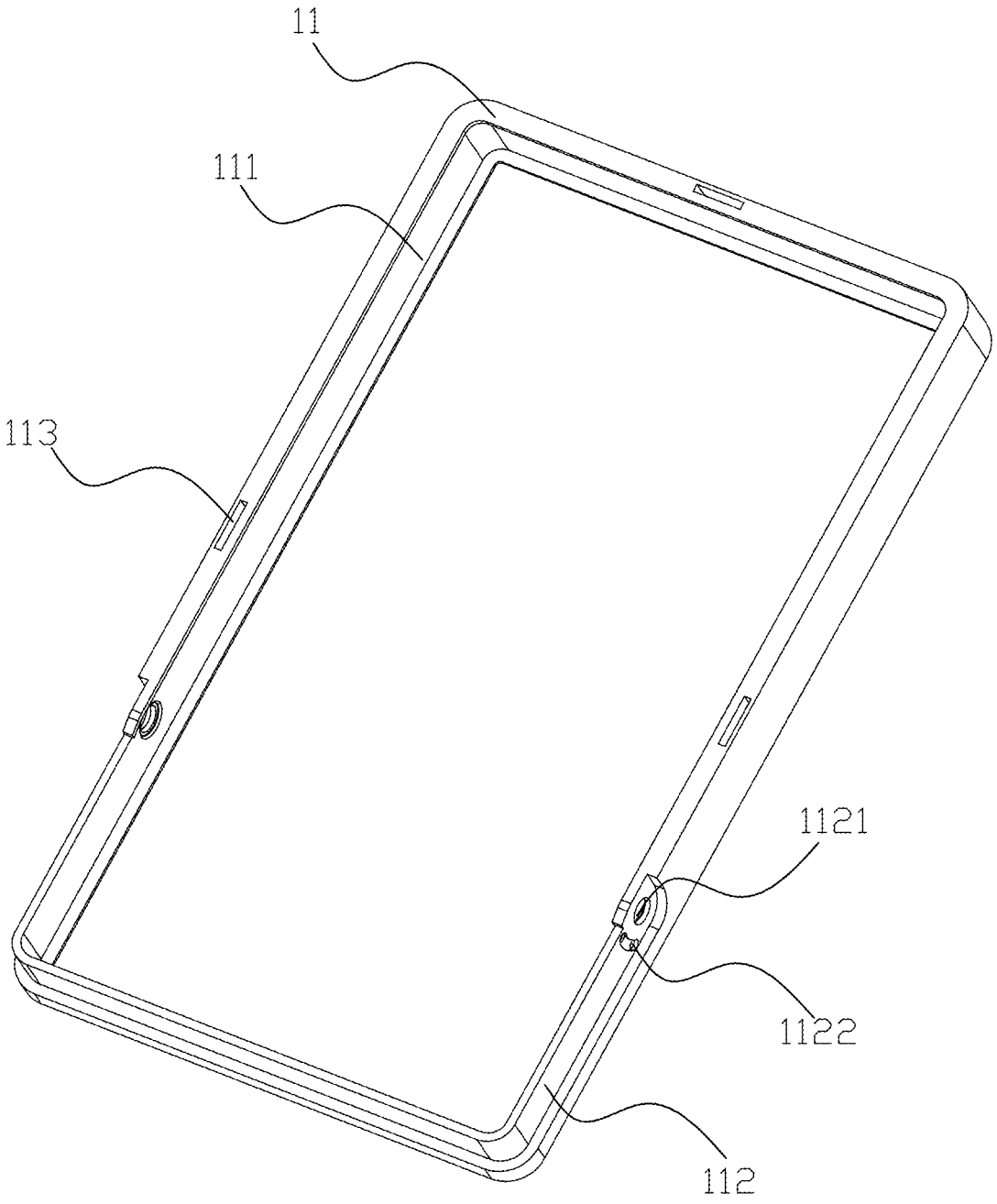
FIG. 6 is a schematic diagram of a three-dimensional structure of a main framework shown in FIG. 5.

Referring to FIG. 5 and FIG. 6, specifically, the main framework 11 is made of a TPU material. The clamping slot 111, the accommodating slot 112, the plurality of fixing cavities 113, and the clamping strip 114 are all integrally formed with the main framework 11. Specifically, rotation holes 1121 are symmetrically provided in two opposite sides of the accommodating slot 112 in a penetrating manner. Two ends of the supporting frame 14 are respectively rotatably arranged in the corresponding rotation holes 1121, so that the supporting frame 14 can be rotated relative to the main framework 11. A plurality of limiting holes 1122 are respectively provided in side edges of the rotation holes 1121. The plurality of limiting holes 1122 respectively limit a supporting angle of the supporting frame 14.

Referring to FIG. 1 to FIG. 5, in this embodiment, the transparent cover plate 12 is made of a PS material and is rectangular. Four sides of the transparent cover plate 12 are fixedly connected to an open end of the main framework 11 by glue. Three magnetic suction members 13 are respectively fixedly mounted in the corresponding fixing cavities 113 on the side wall of the main framework 11. The three magnetic suction members 13 can be detachably sucked onto the showing wall, and the magnetic suction members 13 can also attract the magnetic suction members 13 on an adjacent showing box 10, so that two adjacent showing boxes 10 are detachably connected by magnetic suction. The magnetic suction members 13 use strong magnets. In other embodiments, there may be two, four, or more magnetic suction members 13. A quantity of the magnetic suction members 13 can be set according to actual needs.

Referring to FIG. 1, FIG. 2, FIG. 3, FIG. 4, FIG. 5, and FIG. 7, in this embodiment, the supporting frame 14 is made of a TPU material, and includes two rotation rods 141 and a connecting rod 142. The two rotation rods 141 are oppositely arranged and are respectively rotatably connected to the main framework 11. The connecting rod 142 is fixedly connected between the two rotation rods 141. Through the cooperation between the two rotation rods 141 and the connecting rod 142, the main framework 11 is supported. Specifically, the two rotation rods 141 are integrally formed with the connecting rod 142.

Figure 7:
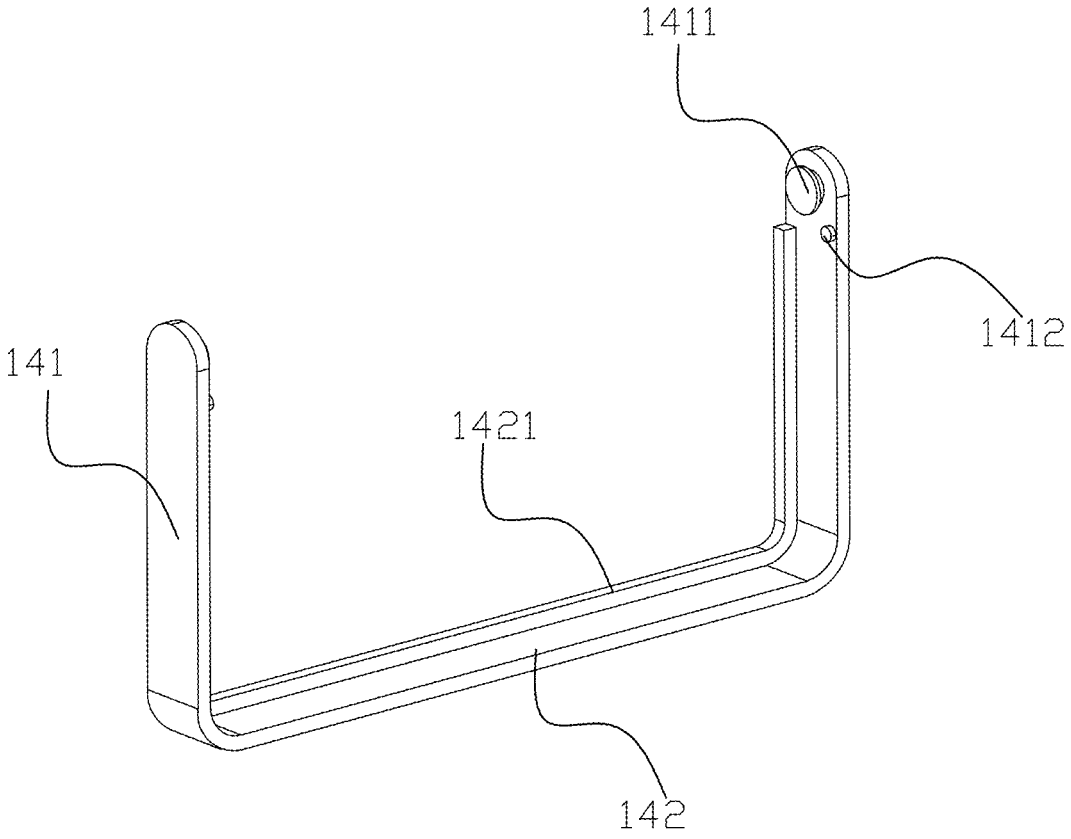
FIG. 7 is a schematic diagram of a three-dimensional structure of a supporting frame shown in FIG. 5.

Referring to FIG. 5 and FIG. 7, specifically, rotation pins 1411 are fixedly arranged on the rotation rods 141. The rotation pins 1411 are rotatably arranged in the corresponding rotation holes 1121, so that the supporting frame 14 can be rotated relative to the main framework 11. Limiting columns 1412 are fixedly arranged at side edges of the rotation pins 1411. The limiting columns 1412 can be respectively in detachable snap-in connection to the plurality of limiting holes 1122, thereby limiting a rotation angle of the supporting frame 14. Specifically, the two rotation rods 141 and the connecting rod 142 can be respectively rotatably accommodated in the accommodating slot 112. Clamping edges 1421 are arranged at side edges of the two rotation rods 141 and a side edge of the connecting rod 142 in a surrounding manner. The clamping edges 1421 can be in detachable snap-in connection to a side edge of the accommodating slot 112, so that a horizontal plane of the supporting frame 14 is flush with a horizontal plane of the side edge of the main framework 11.

Figure 8:
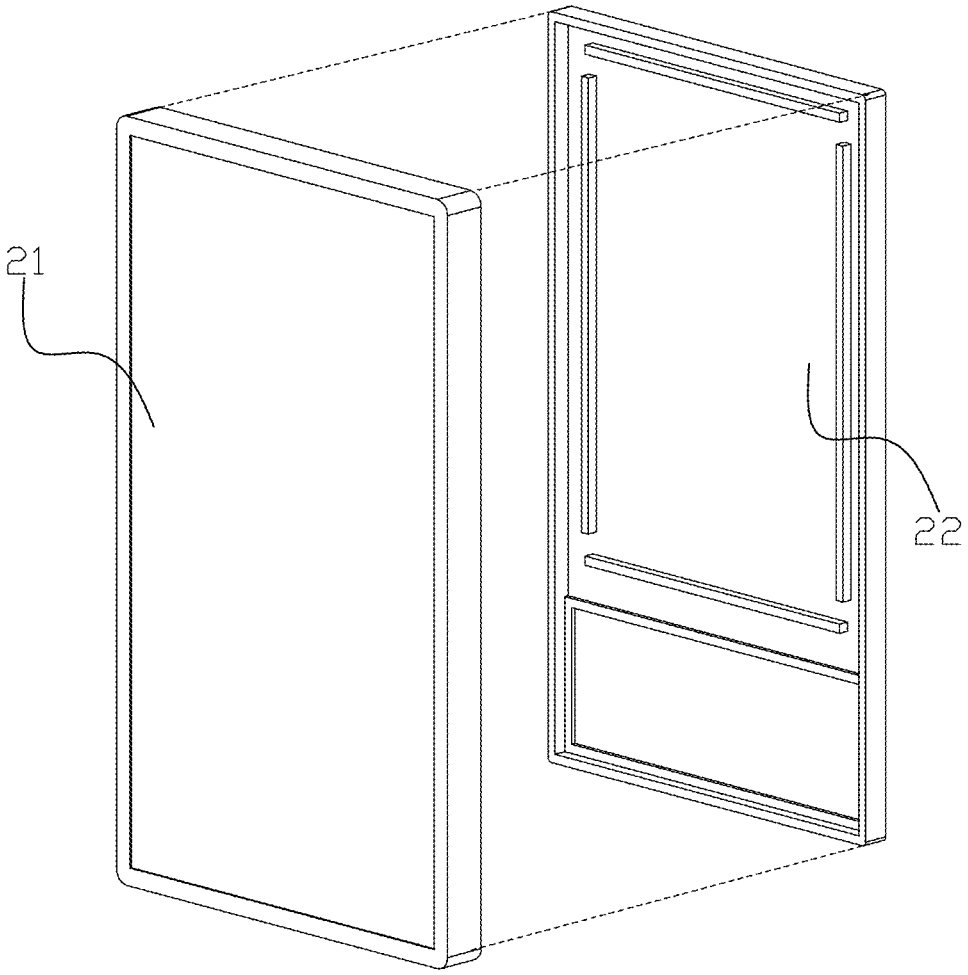
FIG. 8 is a schematic diagram of an exploded structure of an accommodating box shown in FIG. 1.

Referring to FIG. 1, FIG. 3, and FIG. 8, in this embodiment, the accommodating box 20 includes a first shell 21 and a second shell 22. The second shell 22 is detachably arranged on the first shell 21, and the first shell and the second shell form a hollow cavity. The card can be placed in the cavity, so that the card is protected through the accommodating box 20. Specifically, the second shell 22 is detachably arranged on the first shell 21 in a magnetic suction manner or in a snap-in manner, making it convenient to place the card into the accommodating box 20 or take the card out of the accommodating box 20.

It should be noted that a specific working process of the magnetic suction type card showing assembly 1 of the present disclosure is as follows: A card to be shown needs to be first placed into the accommodating box 20, and then the accommodating box 20 with the card is arranged into the clamping slot 111 of the main framework 11 in the snap-in manner, so that the accommodating box 20 with the card can be limited and fixedly mounted in the showing box 10. The card showing assembly can be sucked onto the showing wall for showing through the plurality of magnetic suction members 13, or the folded supporting frame 14 can be taken out of the main framework 11 for supporting and showing, or the supporting frame 14 can be folded into the accommodating slot 112 on the main framework 11 and is then placed on a horizontal showing platform for horizontal showing, so as to meet different showing needs of a user. Meanwhile, stacking and storage between a plurality of card showing assemblies 1 can be implemented by arranging the clamping strip 114 inside the main framework 11 in the snap-in manner, and magnetic suction connection between two adjacent card showing assemblies 1 can also be implemented through mutual suction of the magnetic suction members 13 in two adjacent showing boxes 10.

All the technical features of the above embodiments can be combined randomly. For the sake of brevity, all possible combinations of all the technical features in the embodiments are not described. However, these technical features shall all be considered to fall within the scope of this specification as long as there is no contradiction in their combinations.

The foregoing embodiments merely express several implementations of the present disclosure. The descriptions thereof are relatively specific and detailed, but are not understood as limitations on the scope of the present disclosure. It should be pointed out that a person of ordinary skill in the art can also make several transformations and improvements without departing from the idea of the present disclosure. These transformations and improvements fall within the protection scope of the present disclosure. Therefore, the protection scope of the patent of the present disclosure shall be subject to the appended claims.

What is claimed is:

1. A magnetic suction type card showing assembly, comprising:

a showing box, which is a hollow framework with an opening in one end; and an accommodating box, which is detachably arranged in the showing box in a snap-in manner, wherein a card is detachably placed in the accommodating box, wherein the showing box comprises a main framework, the accommodating box being detachably accommodated inside the main framework; a transparent cover plate fixedly arranged at the opening in one end of the main framework; a plurality of magnetic suction members respectively fixedly arranged on a side wall of the main framework; and a supporting frame detachably accommodated at a side edge of the main framework and capable of rotating relative to the main framework, to implement a supporting operation on the main framework.

2. The magnetic suction type card showing assembly according to claim 1, wherein the main framework is a rectangular cavity with openings in two ends; a clamping slot is provided in an inner side of the main framework; and the accommodating box is detachably arranged inside the clamping slot in a snap-in manner.

3. The magnetic suction type card showing assembly according to claim 2, wherein the accommodating box comprises a first shell and a second shell that are detachably connected to each other, and the first shell and the second shell form a hollow cavity; and the card is placed in the cavity.

4. The magnetic suction type card showing assembly according to claim 3, wherein the second shell is detachably arranged on the first shell in a magnetic suction manner or a snap-in manner.

5. The magnetic suction type card showing assembly according to claim 1, wherein an accommodating slot is provided in the side edge of the main framework, and the supporting frame is rotatably arranged in the accommodating slot.

6. The magnetic suction type card showing assembly according to claim 5, wherein rotation holes are symmetrically provided in two opposite sides of the accommodating slot in a penetrating manner; two ends of the supporting frame are respectively rotatably arranged in the corresponding rotation holes; and a plurality of limiting holes are respectively provided in side edges of the rotation holes.

7. The magnetic suction type card showing assembly according to claim 6, wherein the supporting frame comprises two rotation rods which are oppositely arranged and are respectively rotatably connected to the main framework; and a connecting rod fixedly connected between the two rotation rods.

8. The magnetic suction type card showing assembly according to claim 7, wherein the two rotation rods are integrally formed with the connecting rod.

9. The magnetic suction type card showing assembly according to claim 7, wherein rotation pins are fixedly arranged on the rotation rods; the rotation pins are rotatably arranged in the corresponding rotation holes; limiting columns are fixedly arranged at side edges of the rotation pins; and the limiting columns are capable of being respectively in detachable snap-in connection to the plurality of limiting holes.

10. The magnetic suction type card showing assembly according to claim 7, wherein the two rotation rods and the connecting rod are respectively rotatably accommodated in the accommodating slot; clamping edges are arranged at side edges of the two rotation rods and a side edge of the connecting rod in a surrounding manner; and the clamping edges are in detachable snap-in connection to a side edge of the accommodating slot.

11. The magnetic suction type card showing assembly according to claim 1, wherein a plurality of fixing cavities are arranged on the side wall of the main framework, and the plurality of magnetic suction members are respectively fixedly arranged in the corresponding fixing cavities.

12. The magnetic suction type card showing assembly according to claim 11, wherein the magnetic suction members use magnets.

13. The magnetic suction type card showing assembly according to claim 1, wherein an annular clamping strip is arranged on one side of the main framework in a protruding manner; the clamping strip and the transparent cover plate are arranged on the same side; and the clamping strip is higher than a horizontal plane of the transparent cover plate.

14. The magnetic suction type card showing assembly according to claim 13, wherein the transparent cover plate is made of a polystyrene (PS) material and is rectangular; and four sides of the transparent cover plate are fixedly connected to an open end of the main framework through glue.

15. The magnetic suction type card showing assembly according to claim 1, wherein both the main framework and the supporting frame are made of a thermoplastic polyurethane (TPU) material.

* * * * *